United States Patent [19]

Hausleithner

[11] 4,088,344

[45] May 9, 1978

[54] SKI BOOT HEEL RELEASE BINDING FOR SKIS

[76] Inventor: Andreas Hausleithner, Penk-Str. 5, D-8102 Mittenwald, Germany

[21] Appl. No.: 753,681

[22] Filed: Dec. 23, 1976

[30] Foreign Application Priority Data

Dec. 24, 1975 Austria ..... 9842/75

[51] Int. Cl.[2] ..... A63C 9/08

[52] U.S. Cl. ..... 280/626; 280/634

[58] Field of Search ..... 280/626, 634

[56] References Cited

U.S. PATENT DOCUMENTS

| | | | |
|---|---|---|---|
| 3,795,407 | 3/1974 | Nagasaki | 280/626 |
| 3,873,110 | 3/1975 | Ramillon | 280/626 |
| 3,961,801 | 6/1976 | Korger | 280/626 |

*Primary Examiner*—Robert R. Song

*Attorney, Agent, or Firm*—McGlew and Tuttle

[57] ABSTRACT

A ski boot heel release binding, comprises a mounting base plate which is adjustably connected to a toe jaw part via a touring plate. The base plate includes an upstanding portion which supports a transversely positioned heel mounting pivot. A heel holder includes a slot which is vertically elongated on the holder in the closed position which forms a guide for the mounting pivot to pivotally mount the heel holder on the base plate upstanding portion. The heel holder includes a heel engaging sole-holder portion and a treadnose portion which may be engaged by the boot when in an open position to press the heel holder downwardly by rotation on its pivot to a closed position. A bolt pivot is carried on the heel holder at the lower end on the end opposite the nose and it rides in a guideway of a rotatable disc which is mounted on the upstanding portion for rotation thereon. A release lever is pivotally mounted adjacent the guide disc and it includes a first arm portion which carries an adjustable cam thereon which may be positioned to engage a control pin on the guide member in a closed position of the binding.

8 Claims, 4 Drawing Figures

SKI BOOT HEEL RELEASE BINDING FOR SKIS

FIELD AND BACKGROUND OF THE INVENTION

This invention relates in general to the construction of ski release bindings and, in particular, to a new and useful ski boot heel release binding which includes a heel holder which is provided with a sole holder portion and a treadnose and a release lever, wherein, the heel holder is pivotable about a stud which extends transversely to the longitudinal direction of the ski and is mounted for displacement against the force of at least one spring acting between the stud and the heel holder and, wherein, the heel holder has a pivot engaged in a guideway, the end portions of which are associated with the open and closed positions of the heel holder.

DESCRIPTION OF THE PRIOR ART

The present invention relates to a release binding for skis, including a heel jaw comprising a heel holder and a release lever, in which the heel holder is provided with a sole holder and a treadnose and is pivotable about a pin extending transversely of the longitudinal direction of the ski, and is mounted for displacement against the force of at least one spring acting between the pin and the heel holder.

Many heel jaws for release bindings of various design are known. Some designs require a manual latching of the jaw on the ski boot. This does not meet the skier's need of an automatic locking mechanism, however.

Automatically closing release heel jaws mostly comprise an expensive mechanism for releasing the boot upon a forward fall of the skier. In bindings of the prior art, to obtain a definite release force, spring-biased balls, flattened bolts, or other snap elements bearing against respective abutments are used. Starting from an adjustable torque of the boot, these elements tip from their stable rest position and release the boot. Spring-biased control cams applying the retaining force through a bolt of the heel holder are also used.

A fundamental drawback of such release mechanisms is that the necessary holding force can be increased only by biasing a spring. The result is that, particularly at high adjusted release forces, the binding loses its resiliency, is no longer capable of damping small shocks and releases upon short, hard, shocks which, in themselves, are not dangerous to the skier. Further, the snapping range of such bindings is very small and they fail to engage with relatively thin snow layers on the boot sole or the ski, or they may unexpectedly disengage during the run. They are also highly susceptible to failures, because of the great number of individual parts.

SUMMARY OF THE INVENTION

The present invention is directed to a heel jaw in which the drawbacks of the prior art are avoided and which is simple in construction and ensures a long-stroke resilient connection between the boot and the ski.

In accordance with the invention, it is provided that the heel holder engages, by at least one bolt or the like, a guideway which, preferably, is designed as a groove, the end portions of which are associated with the open and closed positions of the heel holder.

In an advantageous embodiment, the heel jaw is symmetrical of its center line in the longitudinal direction of the ski. The heel holder comprises a sole holder and a treadnose and is guided between two lateral walls which form a fixed casing. In a preferred embodiment, the heel holder is designed as a hollow body in which the spring is received and which is pivotable about a fixed stud extending through a slot provided in the spring chamber in the longitudinal direction, and about bolts which run in guideways of the lateral walls.

It is also advantageous to provide in the spring chamber a helical spring which bears by one of its ends against the fixed stud and by its other end against a screw plug closing the spring chamber at the bottom, so that the spring casing is permanently spring-loaded.

Another advantageous embodiment is to design the guideways in which the bolts are guided as grooves which are provided in rotatable discs so that the position of the grooves can be varied by turning the discs. Advantageously, each of the guideways is formed by two groove portions extending at an obtuse angle relative to each other so that at an exactly predeterminable spring tension, the heel holder changes its open position into the closed position and inversely. In a preferred embodiment, the open position is determined by one end of a recess which is provided on the periphery of the discs and which abuts against a stop, while the closed position is determined either by the other end of the recess or by a pin connecting the two discs and abuting against an adjustable cam. It is further advantageous if this cam is guided in the release lever and can be continuously adjusted by means of a screw. Preferably, the heel jaw is made of a plastic and may be integral with a touring plate.

Accordingly, it is an object of the invention to provide a ski boot heel release binding which includes a heel holder which is pivoted on a mounting pivot which is confined in a slot of the heel holder and which is biased between the heel holder and the mounting plate and which also includes a bolt pivot which is engaged in a guideway of a movable member which may be shifted by a release lever through engagement of a cam thereon with a pin on the movable member to change the orientation of the guideway in the closed and open positions.

A further object of the invention is to provide a heel release binding for skis which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
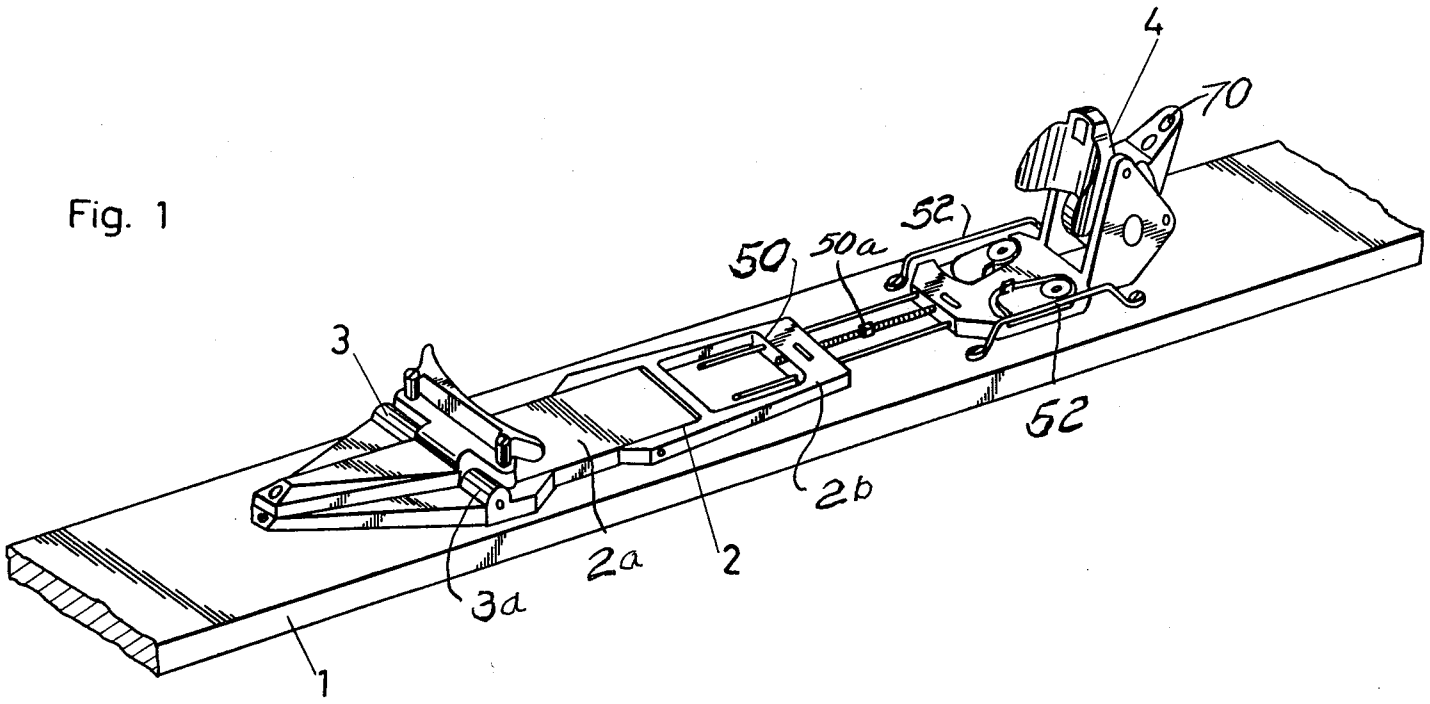
FIG. 1 is a front top perspective view of a ski binding having a heel release constructed in accordance with the invention.

Referring to the drawings in particular, the invention embodied therein comprises a ski boot binding for a ski 1, which includes a touring plate portion with a front toe release binding or toe jaw 3 and a rear heel release binding or heel jaw 4. At its front end, the touring plate 2 is hinged to a base plate 3*a* of the toe jaw 3 and is constituted by two parts 2*a* and 2*b* which again are hinged to each other in the zone of the ball of the foot, whereby, the bending of the ski boot sole during the touring travel is made possible. The rear part 2*b* of the touring plate 2 comprises a mechanism 50*a* for longitudinal adjustment permitting the adjustment of the binding to the size of the ski boot. Heel jaw 4, which is integral with touring plate 2, can be fixed to the ski by means of laterally extensible locking elements 52 which engage below retaining clips.

Figure 2:
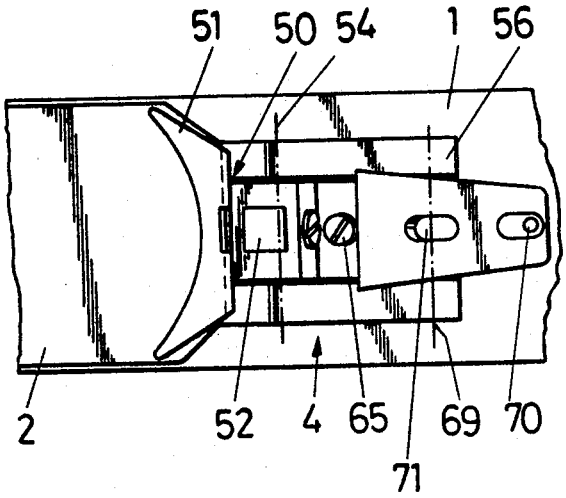
FIG. 2 is a top plan view of the heel jaw in a closed position.
Figure 3:
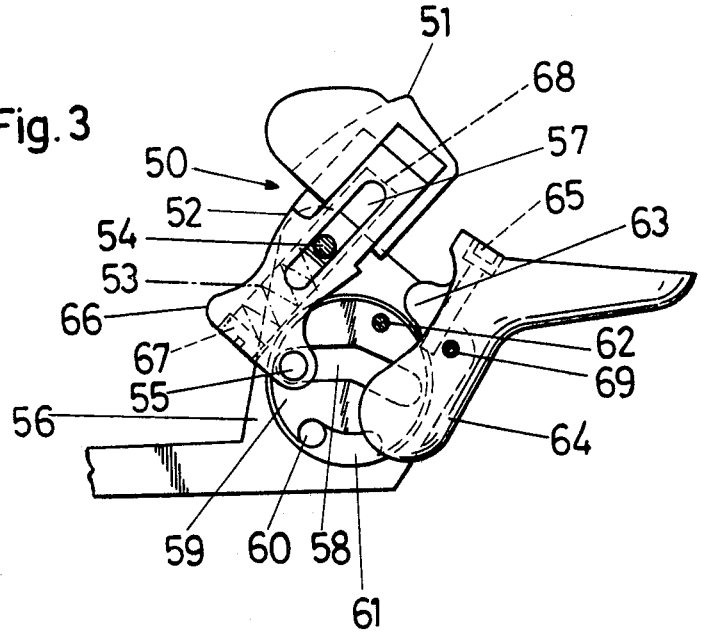
FIG. 3 is a partial side elevational view of the heel jaw in an open position with one of the lateral walls of the casing being omitted.

A heel holder 50 comprising a sole holder 51 and a spring box 52 is guided between a fixed casing 56 (FIG. 2) which is integral with touring plate 2 and formed of two lateral walls. Sole holder 51 is displaceably screwed to spring box 52 and can be adjusted to various heel heights. Spring box 52 is designed as a hollow body which, in the closed position of the heel jaw, extends approximately vertically. A stud 54 secured in the lateral walls of casing 56 extends through a slot 57 which is provided along spring chamber 68. Spring 53 bears against this stud 54 and against a screw plug 67 closing spring chamber 68, so that spring box 52 is urged downwardly. At its lower end, spring box 52 is provided with lateral bolts 55 which are located opposite to the treadnose 66 and engage grooves 58 which are obtusely angled. Grooves 58 are provided in discs 59 which are mounted in the lateral walls of casing 56. Discs 59 are rotatable and their range of rotation may be limited by a recess 61 provided on the periphery of discs 59 and a stop 60 engaging therein, and unilaterally narrowed by a pin 62 by which the parallel discs 59 are connected and which abuts against a cam 63 of release lever 64. In the closed position of the heel jaw, pin 62 bears against cam 63, whereby, the position and setting angle of groove 58 is determined. Cam 63 is adjustable by means of a screw 65 engaging an internal thread of cam 63 and its position can be read on a color marking on release lever 64. As the skier, while inserting the ski boot into the open binding as shown in FIG. 3, steps on treadnose 66 of heel holder 50, bolts 55 slide, against a spring load, along groove 58 and upon reaching the break of groove 58, heel holder 50 suddenly snaps into the closed position while turning about stud 54 and shifting downwardly.

Figure 4:
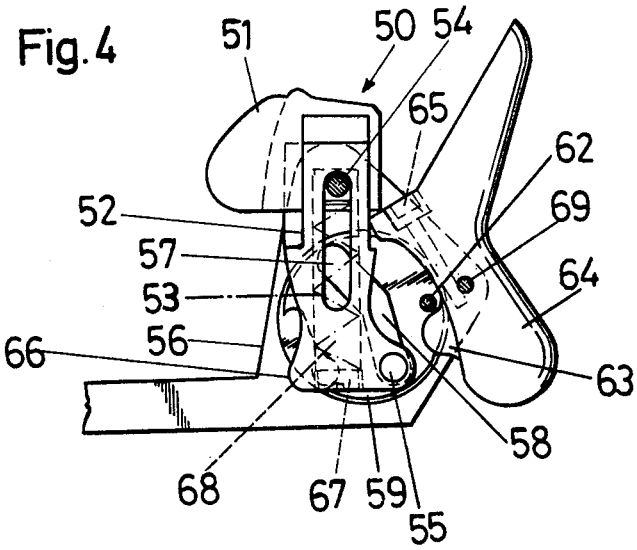
FIG. 4 is a lateral elevational view of the same heel jaw in a closed position with the adjusted greatest release force.

In the closed position, as shown in FIG. 4, bolt 55 of heel holder 50 abuts the other end of groove 58, while disc 59 has turned clockwise and by pin 62 now abuts cam 63 of release lever 64. Consequently, by adjusting cam 63, the release force can be adjusted. FIG. 3 shows the lightest adjustment, i.e., cam 63 is in its uppermost position. In this position, the angle of groove 58 is identical both for the closed and the open position. Now, if upon a fall, the ski boot pulls heel holder 50 upwardly, bolts 55 move, under a simultaneous compression of spring 53, along grooves 58 upwardly and as soon as they pass beyond the break of grooves 58, heel holder 50 snaps into the open position and releases the ski boot. The hardest adjustment is shown in FIG. 4 since here, cam 63 is in its lowermost position and disc 59 utilizes its entire range of rotation. In this position, however, as a rule, bolt 55 of spring box 52 will not travel up to the end of groove 58 but, since sole holder 51 applies against the ski boot sole, will stop in a somewhat higher position. By displacing sole holder 51 on spring box 52, the basic tension to which the ski boot is exposed and, thereby, also the possible lifting of the boot, may be adjusted. If the ski boot now pulls heel holder 50 upwardly, bolts 55 must run beyond the break of grooves 58, in order to turn discs 59 counterclockwise and thus permit a transition into the open position.

Heel holder 50 can be opened by release lever 64 which is pivotable about an axis 69, manually or with the aid of the ski pole introduced into a funnel 70 or through an oblong slot 71. This makes the release lever 64 turn clockwise during which motion the lever first takes along pin 62, by cam 63, thereby turning disc 59 into the softest release position, and then engages spring box 52 from below and shifts it into the open position.

It is easy to understand that the design may be varied in many ways without exceeding the scope of the invention. For example, instead of bolts 55 and groove 58, other guide means may be provided.

While a specific embodiment of the invention has been shown and described in detail to illustrate the application of the principles of the invention, it will be understood that the invention may be embodied otherwise without departing from such principles.

What is claimed is:

1. A ski boot heel release binding, comprising a mounting base plate having an upstanding portion, a transversely extending horizontal heel mounting pivot on said upstanding portion, a heel holder pivoted on said mounting pivot and having a sole holder portion and a treadnose portion and having an elongated slot into which said mounting pivot extends, spring means biased between said mounting pivot and the lower end portion of said heel holder, a bolt on said heel holder at a downwardly and rearwardly spaced location from the slot, a guide member rotatably mounted on said mounting base plate and having a guideway defined thereon into which said bolt extends for movement along said guideway from the opened position to the closed position, a release agent to shift said heel holder with said bolt along said guideway into the opened position.

2. A ski boot heel release binding, according to claim 1, wherein said guideway being displaceable between a substantially horizontal release position and a substantially vertical closed position.

3. A ski boot heel release binding, according to claim 1, wherein said guide member comprises a rotatable disc mounted on said upstanding portion of said mounting base plate, stop means for limiting the turning range of said disc.

4. A ski boot heel release binding, according to claim 1, wherein said guideway comprises an obtusely angled groove.

5. A ski boot heel release binding, according to claim 1, where said guide member on a rotatable disc mounted on said upstanding portion of said mounting base plate, stop means for limiting the turning range of said disc, and a central pin on said disc engageable with a movable cam for the displacement of said guideway.

6. A ski boot heel release binding, according to claim 5, wherein said release agent pivoted on said mounting base plate adjacent said rotatable disc and having first and second arm portions with an engagement part between said arm portions, said cam movably mounted on said lever first arm portion, adjustment means on said lever connected to said cam to move said cam along said first arm portion, said control pin on said disc engageable with said cam for the displacement of said guideway.

7. A ski boot heel release binding, according to claim 6, wherein said adjustment means comprises a bolt threaded into said lever and engaged with said cam for moving said cam along said first cam arm.

8. A ski boot heel release binding, according to claim 1, including a touring plate connected to said base plate.

* * * * *